US007694588B2

(12) United States Patent
Stehlin et al.

(10) Patent No.: US 7,694,588 B2
(45) Date of Patent: Apr. 13, 2010

(54) ADJUSTMENT AND STABILIZATION UNIT WITH A FORCE-SENSING DEVICE FOR TORQUE MEASUREMENT

(75) Inventors: Bernd Stehlin, Leinfelden-Echterdingen (DE); Peter Eisele, Echterdingen (DE)

(73) Assignee: Moog GmbH, Boeblingen (DE)

( * ) Notice: Subject to any disclaimer, the term of this patent is extended or adjusted under 35 U.S.C. 154(b) by 613 days.

(21) Appl. No.: 11/407,774

(22) Filed: Apr. 20, 2006

(65) Prior Publication Data

US 2007/0068287 A1 Mar. 29, 2007

(30) Foreign Application Priority Data

Apr. 25, 2005 (DE) ..... 20 2005 006 590 U

(51) Int. Cl.
*G01L 3/14* (2006.01)

(52) U.S. Cl. ..... 73/862.322

(58) Field of Classification Search ..... 73/862.322
See application file for complete search history.

(56) References Cited

U.S. PATENT DOCUMENTS

| | | | | |
|---|---|---|---|---|
| 2,391,965 | A * | 1/1946 | Hanna et al. | 89/41.12 |
| 2,591,697 | A * | 4/1952 | Hays, Jr. | 74/5.34 |
| 2,967,430 | A * | 1/1961 | Leighton | 74/5 F |
| 3,019,711 | A * | 2/1962 | Bailey et al | 89/41.02 |
| 3,795,784 | A * | 3/1974 | Moll et al. | 219/121.68 |
| 4,326,447 | A * | 4/1982 | Kauer et al. | 89/41.12 |
| 4,353,446 | A * | 10/1982 | Wilken et al. | 192/21 |
| 4,523,487 | A | 6/1985 | Pietzsch | |
| 5,327,061 | A * | 7/1994 | Gullapalli | 318/649 |
| 5,910,720 | A * | 6/1999 | Williamson et al. | 318/623 |
| 6,694,828 | B1 * | 2/2004 | Nicot | 73/862.326 |

FOREIGN PATENT DOCUMENTS

| | | |
|---|---|---|
| DE | 4317935 A1 | 12/1994 |
| GB | 7244896 A | 2/1955 |
| GB | 1605103 A | 12/1981 |

* cited by examiner

*Primary Examiner*—Lisa M Caputo
*Assistant Examiner*—Octavia Davis
(74) *Attorney, Agent, or Firm*—Phillips Lytle LLP

(57) ABSTRACT

An adjustment and stabilization unit (1), such as for a weapon, includes a movable platform (3), a rotational mass (2) mounted on the platform and stabilized in inertial space, and an adjustment drive (6) for adjusting the rotational mass. The adjustment drive includes a driving device (7) connecting the adjustment drive with the rotational mass, a force-sensing device (16) for measuring torque, and at least one stabilization control circuit for controlling the rotary adjustment drive by means of the measured torque. The force-sensing device (16) has an annular design and is arranged between the platform (3) and the adjustment drive (6). The driving device has a shaft (10) that extends through force-sensing device (16). The force-sensing device measures the torque transmitted between the adjustment drive and the platform, and being transmitted to the adjustment drive as a result of an acceleration of the rotational mass.

17 Claims, 4 Drawing Sheets

ADJUSTMENT AND STABILIZATION UNIT WITH A FORCE-SENSING DEVICE FOR TORQUE MEASUREMENT

TECHNICAL FIELD

The present invention relates to an adjustment and stabilization unit, such as for adjusting and stabilizing a weapon. The unit includes a movable platform, a rotational mass movably mounted on the platform and stabilized in inertial space, and an adjustment drive for adjusting the position of the rotational mass relative to the platform. The adjustment drive includes a driving device, a force-sensing device for measuring torque, and a stabilization control circuit for controlling the adjustment drive as a function of the measured torque.

BACKGROUND ART

The stabilization of the position of a rotational mass in inertial space on a moving platform (e.g., a rotary weapon unit mounted on a vehicle) is usually not achieved by controlling the rotational speed of the mass relative to the platform, but by controlling the rotational speed or the position of the rotational mass in inertial space by means of a gyroscope. The output signal of the gyroscope is supplied to a control circuit that compares the deviation of the actual position of the mass in space with a commanded position, and produces an error signal that is supplied to the stabilization drive.

The accuracy of the stabilized inertial position (i.e., the position of the mass in a coordinate unit moving linearly at constant speed) is influenced by various factors, such as the friction of the drive, the manner by which the rotational mass is held, the magnitude of the mass unbalance, and the rotary moment of inertia of the rotating mass. In a moving platform with a stabilized rotational mass, the rotating driving masses have to be accelerated or decelerated in a manner coordinated with movement of the platform during the same interval of time. Each error between these two coordinated motions results in a corresponding error in the stabilization angle. Depending on the extent of deviation from the desired stabilization angle, high or low stabilization quality is achieved with such a stabilization drive. In order to achieve high stabilization quality, various methods for stabilizing the position of a rotational mass are known and will be briefly described below.

The adjustment drive can be designed such that the inertia of the driving masses is very small. This can permit the use of direct drives (e.g., annular torque motors) which are constructed about the rotational axis of a drive without any gears. Such direct drives have to supply all of the torque necessary for to adjust the position of the rotational mass, and to eliminate, or at least keep small, the influence of disturbances attributable to the rotating drive parts' own inertia. Such direct drives are known for stabilizing optical devices. For the stabilization of weapon units, corresponding direct drives have been developed theoretically, but not in practice. For weapon units, only adjustment drives with a small gear ratio and a correspondingly-reduced drive mass have been employed. These adjustment drives are only suitable for rotational masses with a small out-of-balance moments, as the holding torque exerted by the drive motor to counter an out-of-balance moment becomes larger as the mass and/or gear ratio becomes larger.

More recent developments in armored vehicles have lead to an increase of the out-of-balance moment of the weapon unit, which is largely attributable to longer barrels of the weapon unit. Due to the increase of the unbalance moment, the requirements on the stabilization drive have been increased, as the stabilization behaviour of such weapons with respect to well-balanced rotational masses is clearly influenced by the vehicle movement in the vertical direction, as well as in the horizontal or azimuthal direction. Due to the increase in the unbalance of the mass, the sensitivity to disturbances in the vertical direction has also increased, with a resulting negative influence on stabilization quality.

Another attempt to reduce the influence of the inertia of the drive masses involves the use of an auxiliary gyroscope for measuring the rotational movement of the moving platform about the rotational axis of the movable mass. According to this method, the measuring signal of this auxiliary gyroscope is supplied to an internal control circuit and is used to cause an anticipatory rotation of the driven masses before the actual measuring gyroscope records an error. However, the practicality of using an auxiliary gyroscope is limited, as the reaction time between generation of the anticipatory signal from the auxiliary gyroscope and the response of the driven rotational mass is too short.

An improvement of stabilization quality can also be achieved if the force exerted by the adjustment drive on the rotational mass, and also the reaction force exerted by the drive on the platform, is measured and used in an internal stabilization control circuit for controlling the adjustment drive. This method is known in hydraulic drives where the differential pressure between the two opposed chambers in a drive cylinder is measured. In this case, the differential pressure is proportional to the force the drive exerts on the rotational mass, and, reactively, on the platform. The force acting in such a hydraulic drive system is proportional to the acceleration of the rotational mass relative to the platform (i.e., is proportional to the derivative of the velocity of the mass relative to the platform with respect to time). With harmonic excitation, this force is at its maximum value when the speed is still just zero.

This type of acceleration control, as a part of a stabilization design, has been known for some time in electric drives in which the force acting on the drive train is sensed. In this technique, force is sensed by measuring the elongation of a linear stabilization drive that transmits the torque of the motor through a spindle to a control piston driving the rotational mass.

An adjustment and stabilization unit with a linear control drive and a torque control circuit for stabilizing a weapon system arranged on a vehicle is described in DE 43 17 935 C2. In this unit, the torque signal taken from a spindle or a gear of the driving device is forwarded to a speed controller that acts on the drive motor through the power electronics. In this process, a set of strain gauges is used as a torque sensor. The strain gauges are interconnected in a bridge circuit, and are arranged in the axial and radial directions at the nose of the spindle, at the drive mounting, or at the retaining device of the driving mechanics.

Such linear control drives are primarily employed for the orientation of weapons with a limited adjustment angle in the elevation direction (e.g., with adjustment angles of up to about 40°). In weapon systems with larger elevation adjustment angles of up to about 90° (e.g., for the use on armored vehicles used for air defense), such linear control drives have considerable disadvantages as the gear ratio of the rotational motion of the motor into the slewing motion of the weapon system into the elevation direction effectively increases with the increase of the adjustment angle, making it difficult to compensate for as to its control and drive. Therefore, in weapon systems requiring larger elevation adjustment angles, rotary drives are used which have a constant gear ratio at all adjustment angles.

For measuring torque, devices are known which can be arranged in the drive train of such a linear drive between the rotor of the motor and the rotational mass to be driven. Such an arrangement would require measuring the torque of moving parts, leading to additional complexity for transmitting the measuring signals (e.g., by means of slip rings, trailing cables, radio, etc.) from the rotating part of the drive to the static part of the stabilization unit. Furthermore, such torquemeters must only be loaded by the torques to be measured, so that lateral forces and bending forces are eliminated by means of a complex mechanical integration of the torquemeter.

Torques can also be measured by measuring the reaction torque exerted on the stator of the motor. The stator of the motor does not rotate, and the signal reflecting the measured torque can be transmitted directly to the stabilization control circuit. This avoids the disadvantages that occur when the measuring signal is transmitted from rotating parts. When the reaction moment is measured at the stator of the motor, no torque occurs when the platform moves and the not-yet accelerated rotor is driven by the still-stationary mass. Hence, the acceleration of the of the still-stationary rotational mass can be measured. With respect to high stabilization quality of the stabilization drive, it is this measuring information that is the most important quantity, as the signal of the driven rotational mass has to be processed with the aim of accelerating the rotor in the control circuit as quickly as possible. However, the torque exerted by the rotational mass is not transmitted to the stator of the motor, as the acceleration moments are supported at the still-stationary mass of the rotor.

A suitable sensing element for determining the torques for an adjustment and stabilization unit must not measure any external influences, which may, for example, arise from linear acceleration forces acting on the adjustment drive, as the platform on which the rotational mass is held can undergo accelerations into all directions.

The object of the present invention is to provide an adjustment and stabilization unit with a simple torquemeter device measuring the torques exerted between a rotational mass and a platform, these torques being generated by the drive as well as by the moving platform.

SUMMARY OF THE INVENTION

This object is achieved by an adjustment and stabilization unit with a force-sensing device for measuring torques. The unit has an annular design, and is arranged between the platform and the adjustment drive. The driving device of the adjustment drive extends through the force-sensing device. The force-sensing device measures the torque transmitted between the adjustment drive and the platform, and the reaction torque exerted by the adjustment drive in response to acceleration of the rotational mass.

The decoupling of the force-sensing device from the adjustment drive prevents exertion of a load on the adjustment drive and its components, as essential portions of the exerted torque and possible bending stresses are transmitted to the force-sensing device. The arrangement of the force-sensing device furthermore permits the use of an adjustment drive designed solely for the requirements of the adjustment and stabilization unit. Apart from rotary drives, linear drives may also be employed. The employment of the force-sensing device furthermore permits matching of the applied torque and a corresponding measuring signal, so that exact control of the drive is possible with a response characteristic matching that of the stabilization control circuit. While the positioning of the force-sensing device between the drive mounting and the adjustment drive produces a certain deviation between the actual measured quantity and the ideal measured quantity (i.e., of the torque exerted on the rotational mass by the moving platform when the rotor is not yet accelerated), by the tailored selection of the adjustment drive, these deviations can be kept so small that a clear improvement of the stabilizing quality is still achieved.

Preferably, the adjustment drive for adjusting the rotational mass is designed as rotary drive, and the force-sensing device is arranged between the drive mounting and the rotary drive. The annular force-sensing device is particularly suited for measuring the torques in a gear train (e.g., due to the rotary drive) caused by the rotational motion of the motor relative to the rotational motion of the rotational mass.

In a preferred embodiment, the adjustment drive comprises an electric motor and at least one single-stage gear, permitting a simple and effective drive for adjusting position of the rotational mass. Depending on the requirements of the adjustment and stabilization unit, the gear can be designed either as a single-stage cylindrical gear for transmitting rotational motion of the electric motor to the rotational mass as evenly as possible, or as a planetary gear train to cause the rotational motion of the rotor, or the acceleration of the rotational mass on the gear, to be direct as possible.

Another embodiment provides that the driving device of the adjustment drive is arranged adjacent the single-stage gear so that the force-sensing device measures the torque arising between the platform and the gear case. This arrangement permits a simple and effective measurement of torque. By the selection of a high gear ratio, the deviation of the measured torque from the actual torque can be kept low, and a particularly good stabilization quality can be achieved.

For determining the torque acting on the rotational mass, the force-sensing device can measure elongation at one point, which elongation is proportional to the torque to be measured. In order to determine the torque to be measured in a more reliable manner, and in order to also be able to detect a non-synchronous elongation as a consequence of bending forces, the force-sensing device can measure elongation two or more points, the elongation being proportional to the torque to be measured.

A convenient embodiment provides that one or more strain gauges measure the elongation. By means of strain gauges, even small elastic deformations can be readily measured. Apart from strain gauges, other extension sensors (e.g., piezoelectric transducers) can be also used to determine the elastic deformations of the force-sensing device.

For compensating mechanical and thermal disturbing influences, the strain gauges can be interconnected to form a measuring bridge. The strain gauges can be connected as a Wheatstone bridge in the form of quarter-, half- or full-bridge (for 1, 2, or 4 active strain gauges, respectively).

A preferred embodiment provides that the stabilization control circuit for controlling the adjustment drive uses measuring signals provided by at least two measuring bridges. Apart from the more precise determination of the torque, in this manner, bending forces acting on the force-sensing device can be determined.

The force-sensing device can consist of two rings that are adapted to be rotated relative to one another in opposite directions, and that are interconnected via elastically-deformable webs, the webs elastically deforming when a torque is transmitted to the rings. By this simple device, a torque of up to 400 Nm can be measured without any plastic deformation. However, via the elastically-deformable webs, which essentially take up the full elastic deformation of the torque transmitted to the rings, torque applied to the adjustment drive can be measured.

For a simple and secure connection of the force-sensing device with the drive mounting and the adjustment drive, the rings can be designed as flanges. Here, the webs are designed as points of measurable elongation for a simple measurement of the elongation.

A preferred embodiment provides that the two rings which can be rotated in opposite directions and/or that the elastically-deformable webs can be made of aluminum. The manufacture of the rings of aluminum permits a good strength for an attachment at the drive mounting and the adjustment drive, while permitting the required elasticity for measuring an elongation.

In the preferred embodiment, the adjustment and stabilization unit comprises a measuring gyroscope arranged at the rotational mass for measuring the movement of the rotational mass in inertial space, and the stabilization control circuit for controlling the adjustment drive converts the gyroscope output signal into control signals for controlling the rotation of the rotational mass. Such a measuring gyroscope, and the associated control circuit permit, the direct orientation of the rotational mass or the stabilization with respect to the movement of the platform and its rotation in inertial space.

The stabilization control circuit for controlling the adjustment drive can convert the signals of a gyroscope of another rotational mass, or the position signal of another rotational mass already stabilized by a gyroscope and/or externally-set adjustment signals, into control signals for controlling the rotation of the mass. The stabilization control circuit may permit control of the adjustment drive with respect to other manipulated variables or movements of the adjustment and stabilization unit, and thus may facilitate the control of the adjustment drive by means of torque measurement.

The use of a force-sensing device in an adjustment and stabilization unit for measuring the torque arising between the adjustment drive and the platform and exerted by the adjustment drive, or as a consequence of an acceleration of the rotational mass on the adjustment drive, the force-sensing device having an annular design and being operatively arranged between the platform and the adjustment drive and the driving device of the adjustment drive extending therethrough, permits an elastic connection of the adjustment drive with the rotational mass in an adjustment and stabilization unit, and thereby the measurement of the exerted torque on a stationary component. The force-sensing device also permits the measurement of not only small torques, but also of large torques transmitted from the motor to the rotational mass at the platform of the adjustment and stabilization unit.

In the following description, the preferred embodiment of the inventive force-sensing device for torque measurement in an adjustment and stabilization unit is explained more in detail by means of the drawing.

DETAILED DESCRIPTION OF THE INVENTION

Figure 1:
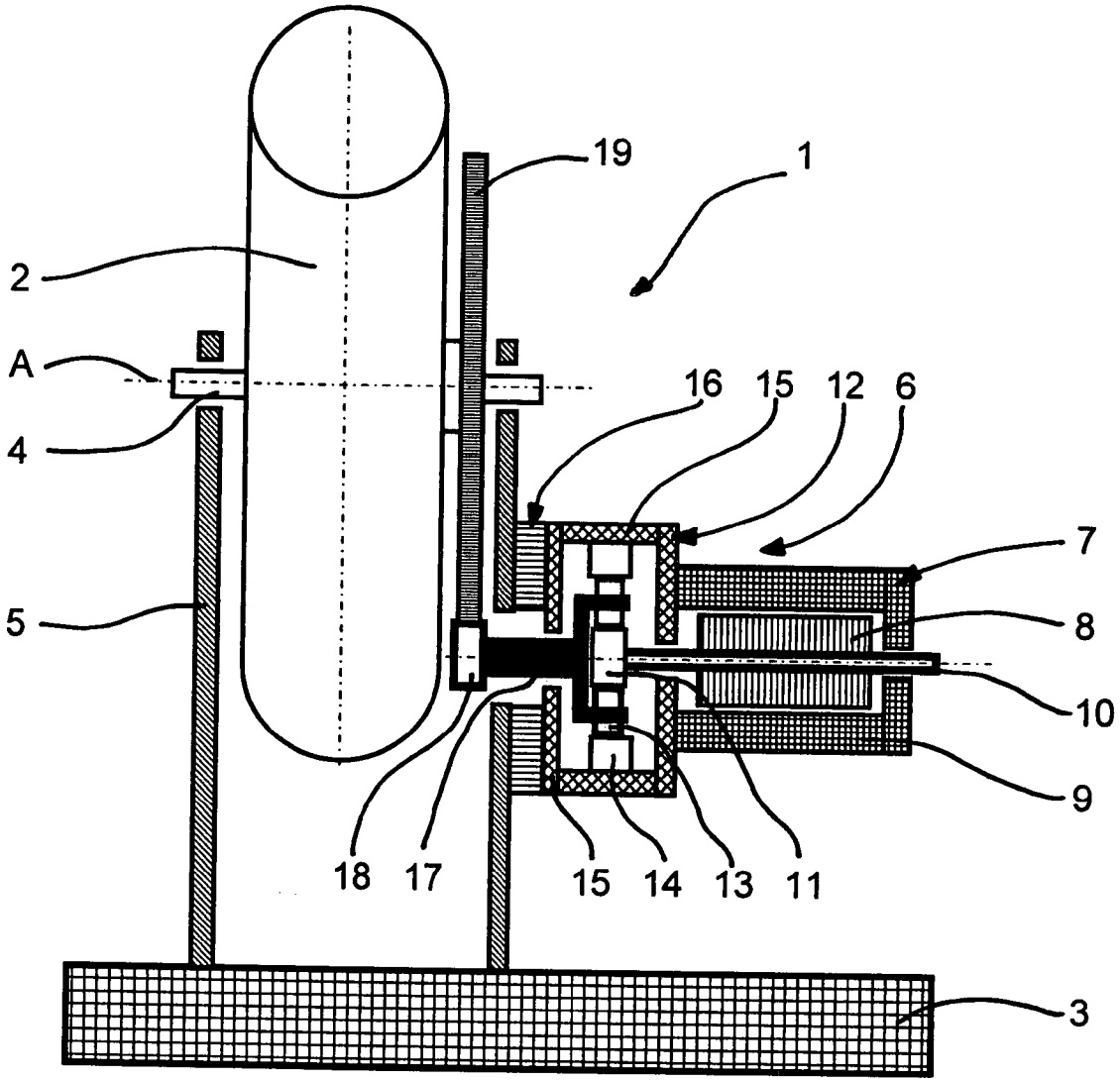
FIG. 1 shows a longitudinal sectional view of an adjustment and stabilization unit with a force-sensing device for torque measurement.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

FIG. 1 shows a section through an adjustment and stabilization unit 1 with a rotational mass 2 (e.g., a weapon) and a movable platform 3 (e.g., the turret arranged on a vehicle). The rotational mass 2 is arranged on a mounting 5 fixed to the platform 3 via a shaft 4, and is mounted for rotation about axis A extending through the shaft 4. The adjustment and stabilization unit 1 further comprises a rotary adjustment drive 6, which includes a motor 7 having a rotor 8, a stator 9, and a rotatable shaft 10 arranged to rotate with the rotor. The motor shaft 10 is provided with a pinion 11 on the driving side, the pinion 11 at the same time forming the sun gear of the planetary gear train 12. In the system, the sun gear 11 drives the planetary gears 13, which in turn engages a ring gear 14 fixed to the gear case 15.

A force-sensing device 16 is arranged and connected to the moving platform 3 via mounting 5. At the force-sensing device 16, on the opposite side of the mounting 5, the planetary gear train 12 is attached to the gear case 15. The planetary gears 13 of gear train 12 drive the rotational mass 2 via the planet cage 17, which extends axially through the force-sensing device 16. The planet cage 17 is coupled to a toothed quadrant or sector 19 fixed to shaft 4, which is connected to the rotational mass 2 via the pinion 18 arranged on the other side of the force-sensing device 16, and thus drives the stabilized rotational mass 2. Thus, the force-sensing device 16 is effectively arranged between the platform 3 and the rotary adjustment drive 6 by the mounting 5 and the gear case 15.

Figure 2:
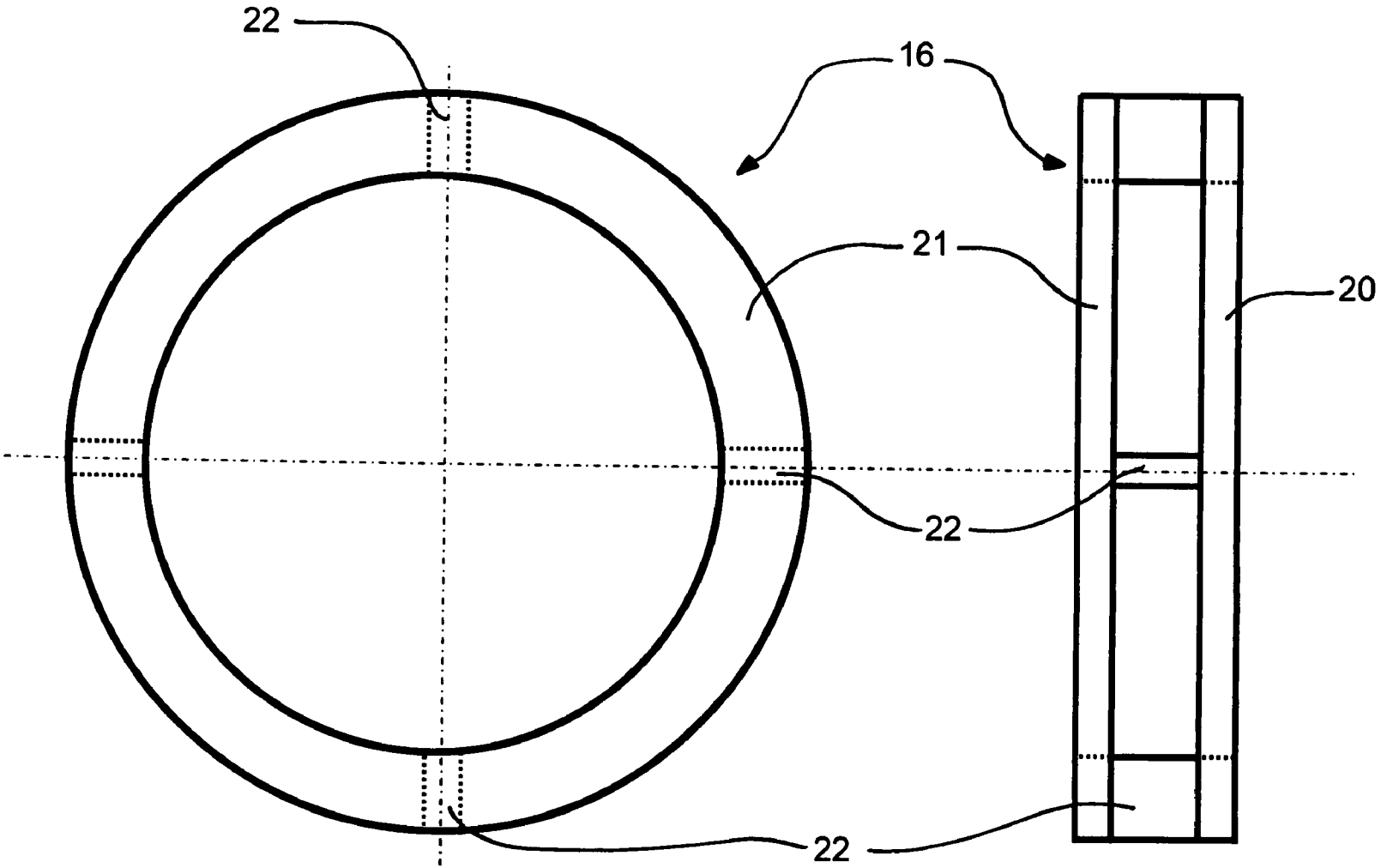
FIG. 2 shows a plan view and a side view of the force-sensing device of FIG. 1.

FIG. 2 shows a side elevation and an end view of the inventive force-sensing device 16, which can measure not only the torque that the motor 7 exerts on the rotational mass 2, but also the reaction torque exerted by the rotational mass 2 and which urges the rotor 8 of the motor 7 to move in the opposite or reverse direction. All other influences of force acting on the adjustment drive 6 (e.g., from linear accelerations of the adjustment and stabilization unit 1 in all directions, from lateral forces acting on the pinion 18, etc.) are not measured by the force-sensing device 16. The force-sensing device 16 consists of two rings 20, 21, which are interconnected by means of several circularly-spaced webs 22. The embodiment of the force-sensing device 16 shown in FIG. 2 uses four webs 22 for interconnecting the two rings 20, 21, the four webs 22 being staggered by equal intervals of 90°. The rings 20, 21, as well as the webs 22, are preferably formed integrally and are made of a unitary material (e.g., aluminum), because joined portions between the webs and rings can otherwise disturb the elastic deformations representing the torque to be measured by the torque sensors. The rings 20, 21 can be designed as flanges for attaching the force-sensing device 16 to the mounting 5 and the gear case 15, and can be provided with corresponding holes for fasteners (not shown) by means of which the force-sensing device may be mounted on such adjoining structure.

Figure 3A:
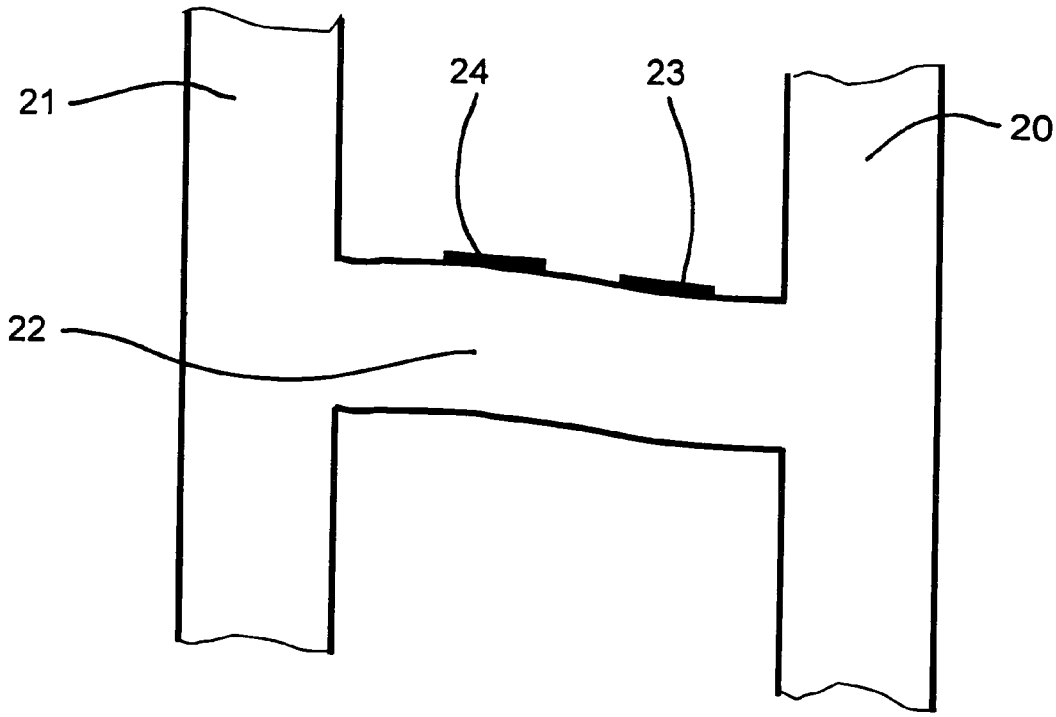
FIG. 3*a* shows an enlarged section of the side views of a web of the force-sensing device of FIG. 2.

As shown in FIG. 3*a*, at least one of the webs 22 is provided with at least two strain gauges 23, 24, which detect an elastic deformation of the associated web as a consequence of a force acting on the force-sensing device, and which output signals proportional to the elastic deformation of the web as a function of the change in electrical resistance of the strain gauges to an evaluation electronics package. With the strain gauges 23, 24 arranged in a staggered manner in the longitudinal direction on the web 22 in parallel to one another, a small elastic "bending" of the webs 22 can be measured. As strain gauges 23, 24 usually provide a measuring signal of only a few millivolts, a suitable evaluation electronics package is required to permit processing of the strain gauge output signals into the form of an input signal required by the stabilization control circuit. This evaluation electronics package can be miniaturized, so that the package can be arranged between the rings 20, 21 of the force-sensing device 16. The evaluation electronics package provides a precision reference voltage of usually +10V for supplying the strain gauges 23, 24, and may include a relatively-driftless amplifier with a 500-fold amplification for the further processing of the signal. If the assembly with the evaluation electronics package is arranged between the rings 20, 21, only terminals for the supply voltage (usually ±15V) are required for the reference mass and the output signal.

Figure 3B:
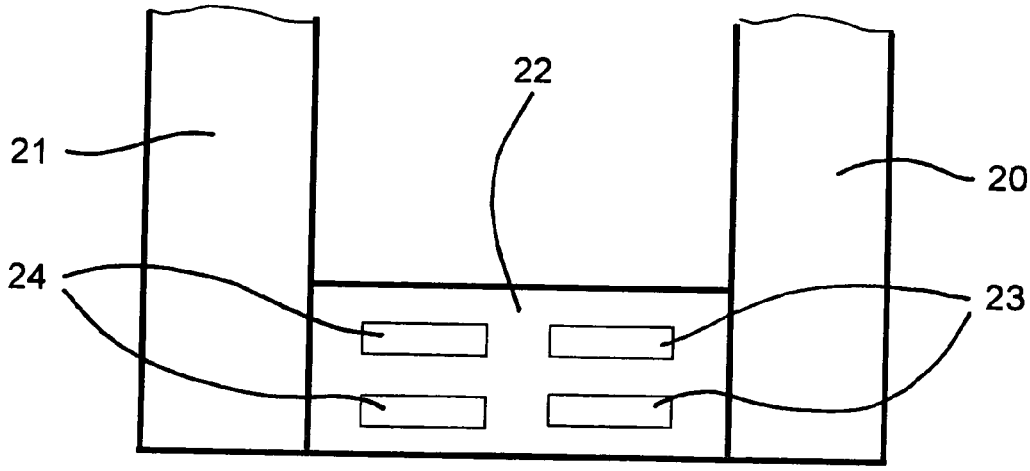
FIG. 3*b* shows an enlarged section of another side view of a web of the force-sensing device of FIG. 2.

FIG. 3*a* further shows the elastic deformation of the web 22 arising as a consequence of a torque rotating the two rings 20, 21 of the force-sensing device 16 in opposite directions. A measuring bridge of strain gauges, in this case including two strain gauges 23, 24, arranged on, or adhered to, a surface of a web 22 (preferably a side face) detects the rotation of the rings 20, 21 in opposite angular directions, by a shortening of the strain gauge 23 and by the lengthening of strain gauge 24, as a consequence of the elastic deformation of the web 22. FIG. 3*b* shows another side view of the force-sensing device 16 with a suitable parallel arrangement of the strain gauges 23, 24 for a full Wheatstone measuring bridge on the web 22, which is also suitable for measuring the torque.

The electronic evaluation of a resistance bridge is not described in detail herein, as the same is generally known to the persons skilled in this art, and does not go beyond the evaluation algorithm common in prior art in the application of the force-sensing device 16 for measuring torques. The fixing means of the rings 20, 21 of the force-sensing device 16 for attaching the load cell at the gear case 15, as well as the mounting 5, are not described in detail herein, as neither the selection nor the employment of suitable fixing means has an essential influence on the function of the force-sensing device 6.

Stretching the two rings 20, 21 in an axial direction by externally-applied forces causes, in case of a symmetrical attachment of the measuring bridge on the web, a equal change of the electrical resistances of strain gauges 23, 24 in the same manner, which does not result in any change of the measuring signal in a measuring bridge. In all other directions, the two rings 20, 21 have a stiff structure by the mutual arrangement and selection of the webs 22. An external bending moment does not result in an important measuring signal. This is particularly important, as there are forces acting on pinion 18 that exert bending moments on the force-sensing device 16. However, if the flexural strength of the force-sensing device 16 is, as a consequence of constructive requirements (e.g., small wall thickness), not sufficient to avoid a measuring signal as a consequence of bending forces on the gear 12, the attachment of a second measuring bridge on a web 22 in a manner opposed to the first measuring bridge, insures that a bending force, which produces a positive signal from the first measuring bridge, will produce a like negative signal from the second measuring bridge. The two signals of the first and second measuring bridges can then be summed or added, which doubles the sensitivity of the combined signals to measured torque, but which cancels any net output signal attributable to such bending force.

Figure 4:
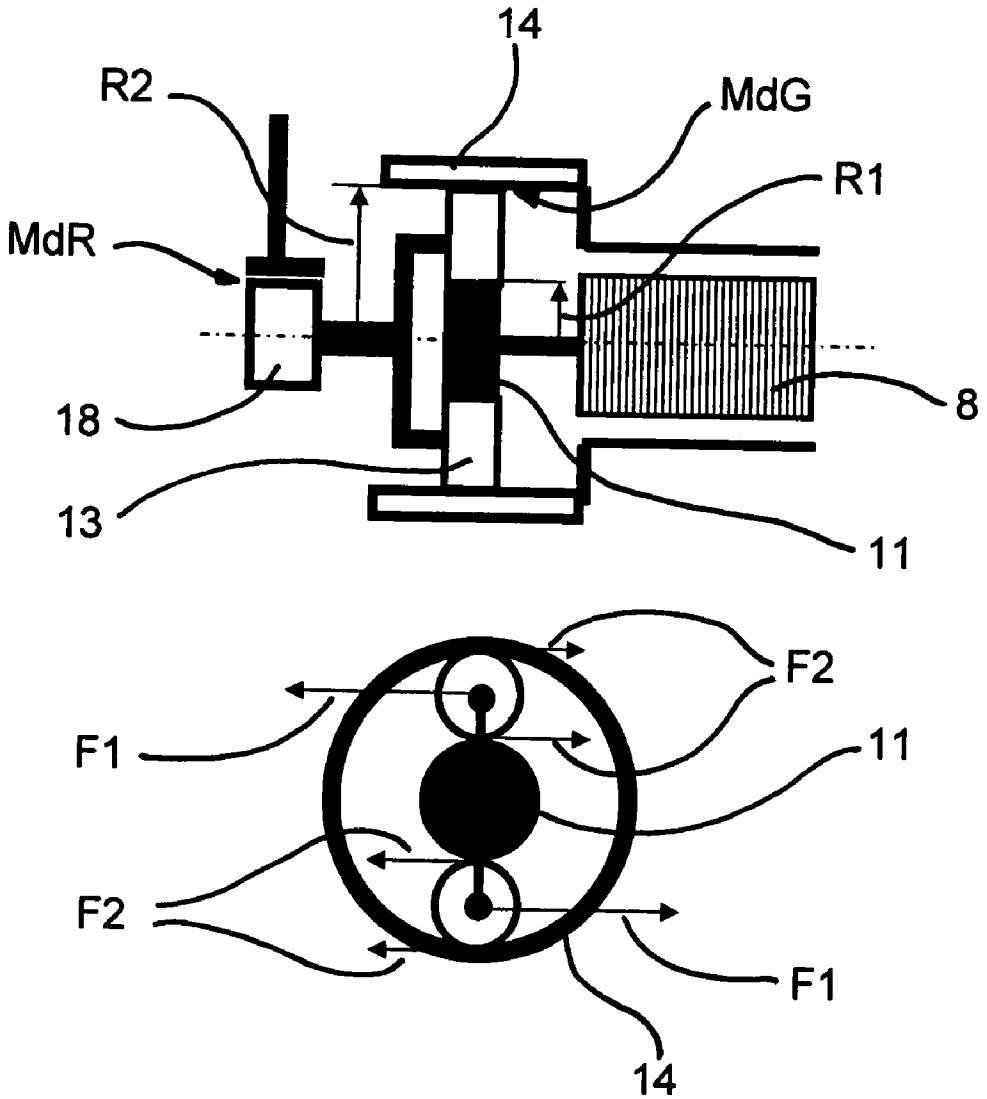
FIG. 4 shows a side view and a plan view of a planetary gear train for the adjustment drive of FIG. 1.

FIG. 4 depicts a longitudinal section of the planetary gear train 12 shown in FIG. 1, as well as a transverse section through the gear train. The forces and torques at the force-sensing device 16 arising in a reverse acceleration of the rotor 8, these torques not being applied by the motor 7 itself, are illustrated by means of this representation. When the moving platform 3 and a motor 7 do not drive the rotational mass 2, the rotational mass 2 reactively drives the motor 7, even in the case of an acceleration due to its own inertial force. The torque developed at pinion 18 is designated as MdR. When rotor 8 of motor 7 is reversely driven by the rotational mass 2, there will be a difference between the torque at the pinion 18 and the torque which is transmitted by the gear case 15 and which is measured by load cell 16. The torque measured at the force-sensing device 16 is designated as MdG.

In FIG. 4, the torque MdR at the pinion 18 and the torque MdG at the ring gear 14 and thus at the gear case 15 and measured by the force-sensing device 16, is represented and evaluated. The torque exerted on the pinion 18 accelerates the rotation of planetary gears 13, which triggers the same torque-forming forces F2 at the sun gear 11 and at the gear case 15. The rotor 8 is angularly accelerated by the torque resulting from forces F2, acting at radius R1 from the center of the planetary gears 13. The torque MdG occurring at the ring gear 14 is also triggered by forces F2, acting at radius R2 from the center of ring gear 14. Here, forces F2 are half of forces F1, which results from a static balance condition (i.e., in equilibrium, the sum of all forces in any direction must be zero).

The torque MdG measured at the gear case 15 is the product of force F2 multiplied by the radius R2. The torque MdR measured at the pinion 18 is the product of force F1 multiplied by the radius to the center of the planetary gears 13 (i.e., R1+(R2−R1)/2). Mathematically, the following equation thus results for the relation of the two torques:

$$MdG/MdR=F2\times R2/F1\times(R1+(R2-R1)/2)$$

If force F1 is twice force F2 (i.e., F1=2×F2), the foregoing equation simplifies to:

$$MdG/MdR=R2/(R2+R1)$$

In a gear train 12, the gear ratio GR is defined by the relation of the two radii R1 and R2 as follows:

$$GR=1+R2/R1$$

Or, $$R2=(GR-1)/GR$$

This results in the following relation of the measured torque at the gear train 12 to the torque arising at the pinion 18 of the gear 12:

$$MdG/MdR=1-1/GR$$

Thus, for a single-stage gear train 12, the deviation of the measurements of the torque between the drive shaft of the rotational mass 2 and at the gear case 15, or at the force-sensing device 16, respectively, gets smaller as the gear ratio gets higher.

Reversely, one can also recognize that the inventive force-sensing device 16 is not well-suited for very small gear ratios or direct drives. However, with small gear ratios or direct drives, as illustrated in the beginning, a measurement of the induced torque is not necessary.

For multi-stage planetary gear trains and for cylindrical gears, the calculation leads to the same result illustrated above. The representation of the derivation for these cases, however, is dispensed with herein.

The torques transmitted from the motor 7 to the rotational mass 2 trigger the same torque at the output pinion 18 as at the stationary gear case 15 or at the force-sensing device 16. The representation of this calculation is also dispensed with.

Therefore, while the presently preferred form of the invention has been shown and described, and several modifications discussed, persons skilled in this art will readily appreciate that various additional changes and modifications may be made without departing from the spirit of the invention, as defined and differentiated by the following claims.

What is claimed is:

1. In an adjustment and stabilization unit (1) having a movable platform (3), a rotational mass (2) mounted on said platform (3) and stabilized in inertial space, an adjustment drive (6) for adjusting the position of said rotational mass (2), said adjustment drive (6) being connected to said rotational mass (2) and to said platform (3) and including a driving device (7) connecting said adjustment drive (6) with said rotational mass (2), a force-sensing device (16) for torque measurement, and at least one stabilization control circuit for controlling said adjustment drive (6) as a function of the measured torque, the improvement which comprises:

said force-sensing device (16) having an annular design and being arranged between said platform (3) and said adjustment drive (6), wherein a portion (17) of said driving device (7) extends through said force-sensing device, and wherein said force-sensing device (16) measures the torque transmitted between said adjustment drive (6) and said platform (3) as a function of the acceleration of said rotational mass (2) relative to said adjustment drive (6).

2. The improvement as set forth in claim 1 wherein said adjustment drive (6) is a rotary drive.

3. The improvement as set forth in claim 2 wherein said adjustment drive (6) comprises an electric motor (7) and a single-stage gear train (12).

4. The improvement as set forth in claim 3 wherein said gear train (12) includes a single gear.

5. The improvement as set forth in claim 3 wherein said gear train (12) includes a planetary gear train.

6. The improvement as set forth in claim 5 wherein said gear train includes said driving device portion (17), wherein said driving device (7) includes a gear case (15), and wherein said force-sensing device (16) measures the torque transmitted between said platform (3) and said gear case (15).

7. The improvement as set forth in claim 1 wherein a torque transmitted between said adjustment drive (6) and said platform (3) causes a measurable elongation in at least at one region of said force sensing device (16); the magnitude of such elongation being proportional to such transmitted torque.

8. The improvement as set forth in claim 7 wherein such transmitted torque causes measurable elongations in at least at two regions of said force-sensing device (16), the magnitude of such elongations being proportional to such transmitted.

9. The improvement as set forth in claim 7 wherein each region in which elongation occurs includes at least one strain gauge (23, 24) for measuring the elongation in such region.

10. The improvement as set forth in claim 9 wherein each region in which elongation occurs includes a plurality of strain gauges (23, 24), and wherein such strain gauges are interconnected to form a measuring bridge.

11. The improvement as set forth in claim 10 wherein said stabilization control circuit uses added measuring signals of at least two measuring bridges for controlling said adjustment drive (6).

12. The improvement as set forth in claim 1 wherein said force-sensing device (16) includes two rings (20, 21) that are adapted to be rotated in opposite directions and that are interconnected by means of elastically-deformable webs (22), and wherein said webs (22) elastically deform when a torque is applied to one of said rings (20, 21).

13. The improvement as set forth in claim 12 wherein said webs (22) provide regions of measurable elongation.

14. The improvement as set forth in claim 1 wherein rings (21, 21) are designed as flanges that are adapted to be mounted to adjacent structure.

15. The improvement as set forth in claim 1 wherein said rings (20, 21) and said webs (22) are made of aluminum.

16. The improvement as set forth in claim 1 wherein said adjustment and stabilization unit (1) includes a measuring gyroscope arranged at the rotational mass (2) for measuring the movement of the rotational mass (2) in inertial space, and wherein said stabilization control circuit converts such measured movement into control signals for causing said adjustment drive (6) to rotate said rotational mass.

17. The improvement as set forth in claim 1 wherein said stabilization control circuit converts the signals of a gyroscope of another rotational mass or the position signals of another rotational mass already stabilized by a gyroscope and/or externally-given adjustment signals into control signals for causing said adjustment drive (6) to rotate said rotatable mass.

* * * * *